US006028587A

United States Patent [19]

Igari

[11] Patent Number: 6,028,587

[45] Date of Patent: Feb. 22, 2000

[54] DISPLAY DEVICE FOR CONTROLLING DISPLAY GRADATION IN DISPLAY DOTS BY WRITING IMAGE DATA IN IMAGE MEMORY

[75] Inventor: Shoji Igari, Fukushima-ken, Japan

[73] Assignee: Alps Electric Co., Ltd., Tokyo, Japan

[21] Appl. No.: 09/007,472

[22] Filed: Jan. 15, 1998

[30] Foreign Application Priority Data

Jan. 16, 1997 [JP] Japan ..... 9-005873
Jan. 16, 1997 [JP] Japan ..... 9-005874

[51] Int. Cl.[7] ..... G09G 5/10

[52] U.S. Cl. ..... 345/147; 345/153

[58] Field of Search ..... 345/147, 148, 345/149, 145, 150, 333, 326, 152, 153, 154–155, 112, 133, 118; 395/101, 117, 114

[56] References Cited

U.S. PATENT DOCUMENTS 5,739,808 4/1998 Suga et al. ..... 345/147
5,801,670 9/1998 Greene et al. ..... 345/90
5,805,136 9/1998 Silverbrook et al. ..... 345/149
5,861,869 1/1999 Scheffer et al. ..... 345/147
5,867,137 2/1999 Sugiyama ..... 345/189
5,872,554 2/1999 Chang et al. ..... 345/147
5,892,496 4/1999 Wakeland ..... 345/147
5,907,316 5/1999 Mikoshiba et al. ..... 345/147

*Primary Examiner*—Steven Sax
*Attorney, Agent, or Firm*—Brinks Hofer Gilson & Lione

[57] ABSTRACT

Liquid crystal displays (LCD) have a number of different gradation levels defining the colors in pixels. Blends of the colors and gradation levels of each color are used to change the colors of dots in the LCD. Both the gradation data and address of the data must be transferred from an image data storage to a driver (controlled by a controller) to update the display. This necessarily leads to the transfer of a large amount of data and consequently leads to the use of a correspondingly large amount of current and the consumption of a large amount of power. To decrease the power consumption, an on/off flag is set for each dot in each of the 15 frames that compose a display screen. The gradation of a dot is determined by ratio of on/off states. The state is held for continuous driving by the driver until the next value is written to the memory, i.e. only dots that have intermediate gradations will have a state change. The controller does not regulate/transfer data for colors that are continuously on or off over one screen, thus decreasing the overall current.

17 Claims, 9 Drawing Sheets

FIG. 3

| | | | 001 RGB | 089 | 120 | 169 | 200 | 249 | 280 |
|---|---|---|---|---|---|---|---|---|---|
| 001 | 0 | 0 | 000 | | | | | | |
| 050 | 0 | 1 | | F00 ··· | F00 | 800 ··· | 800 | 100 ··· | 100 |
| | 0 | 1 | | F00 ··· | F00 | 800 ··· | 800 | 100 ··· | 100 |
| 055 | 0 | 1 | | F00 ··· | F00 | 800 ··· | 800 | 100 ··· | 100 |
| 100 | 0 | 1 | | 0F0 ··· | 0F0 | 080 ··· | 080 | 010 ··· | 010 |
| | 0 | 1 | | 0F0 ··· | 0F0 | 080 ··· | 080 | 010 ··· | 010 |
| 105 | 0 | 1 | | 0F0 ··· | 0F0 | 080 ··· | 080 | 010 ··· | 010 |
| 200 | 0 | 1 | | 00F ··· | 00F | 008 ··· | 008 | 001 ··· | 001 |
| | 0 | 1 | | 00F ··· | 00F | 008 ··· | 008 | 001 ··· | 001 |
| 205 | 0 | 1 | | 00F ··· | 00F | 008 ··· | 008 | 001 ··· | 001 |
| 240 | | | | | | | | | |

3b 3a

DISPLAY DEVICE FOR CONTROLLING DISPLAY GRADATION IN DISPLAY DOTS BY WRITING IMAGE DATA IN IMAGE MEMORY

BACKGROUND OF THE INVENTION

1. Field of the Invention

The present invention relates to a display device for controlling display gradation in each display dot of a liquid-crystal display device or the like on the basis of image data (gradation data) written in an image memory such as a VRAM, and a display device comprising the display control device.

2. Description of the Related Art

FIG. 9 is a block diagram showing an arrangement of a conventional display device.

Referring to FIG. 9, a screen size of a liquid-crystal display panel (to be referred to an "LCD panel" hereinafter) 1 is represented by 320 (horizontal)×240 (vertical) pixels. Each pixel is constituted by three dots, i.e., a red (R) dot, a green (G) dot, and a blue (B) dot.

An image data storage unit 3*a* constituted by an IC memory such as a VRAM or the like has a storage capacity of 320×240×3×4=921,600 bits=115,200 bytes. With respect to each display dot (320×240×3 dots) of the LCD panel 1, 4-bit gradation data is allocated. With this arrangement, on each display dot of the LCD panel 1, a gradation display having 16 gradation levels, i.e., (0000)2 to (1111)2, can be performed. Referring to FIG. 9, as the image data storage unit 3*a,* two image data storage units for front and rear screens are arranged to perform a screen switching process.

When a driver 102 receives gradation data (DA) from a controller 105 in synchronism with a clock, corresponding display dots are sequentially driven such that a gradation display represented by the gradation data can be obtained.

In the above arrangement, a CPU 4 writes arbitrary image data (gradation data of one screen) in the image data storage unit 3*a*.

On the other hand, each time the controller 105 receives a predetermined frame signal (pulse signal having an interval of 1/150 sec), the controller 105 sequentially reads gradation data in the image data storage unit 3*a* from a start address, and transfers the read gradation data to the driver 102 together with the address of the gradation data.

The driver 102 is driven such that display dots corresponding to the transferred address perform a gradation display represented by the transferred gradation data.

Each time the frame signal is input, the above process is repeated, an image corresponding to image data written by the CPU 4 is displayed on the LCD panel 1.

In the above conventional display device, each time the controller 105 receives a frame signal, the controller 105 loads all gradation data in the image data storage unit 3*a,* and transfers all the loaded gradation data to the driver 102. For this reason, when the screen size of the LCD panel 1 is large (for example, as shown in FIG. 9, 320 (horizontal)×240 (vertical) pixels or the like), an amount of data to be transferred between the image data storage unit 3*a* and the controller 105 and between the controller 105 and the driver 102 is considerably large.

As a result, in the conventional display device, a current consumed in the data transfer considerably increases.

SUMMARY OF THE INVENTION

The present invention has been made on the above background, and has as its object to provide a display control device and a display device which can reduce an amount of data transferred between an image memory and a display means to suppress a current consumption required for the data transfer.

According to the present invention, there is provided a display control device characterized by comprising: gradation information storage means for storing, in correspondence with each display dot of display means constituted by a plurality of display dots, gradation information representing display gradation of the display dot; presence/absence information storage means for storing, with respect to divided regions obtained by dividing a storage region of the gradation information storage means into a plurality of regions, presence/absence information representing a predetermined value in correspondence with each divided region when at least one piece of gradation information stored in the divided regions represents intermediate gradation; presence/absence information write means for writing the presence/absence information in the presence/absence information storage means on the basis of the gradation information stored in the gradation information storage means; detection means for detecting only a divided region, in which at least one piece of stored gradation information represents intermediate gradation, from the divided regions constituting the gradation information storage means on the basis of the presence/absence information stored in the presence/absence information storage means; gradation information read means for loading only gradation information representing intermediate gradation from the divided region detected by the detection means and outputting the gradation information; and drive means for storing the gradation information output from the gradation information read means and driving and displaying a display dot corresponding to the gradation information in display gradation represented by the gradation information on the basis of the stored gradation information.

According to the present invention, therefore, the presence/absence write means writes presence/absence information in the presence/absence information storage means on the basis of the gradation information stored in the gradation information storage means. The detection means detects only a divided region, in which at least one piece of storage gradation information represents intermediate gradation, from the divided regions constituting the gradation information storage means on the basis of the presence/absence information stored in the presence/absence information storage means, and the gradation information read means loads only gradation information representing intermediate gradation from the divided region detected by the detection means and outputs the gradation information. The drive means stores the gradation information output from the gradation information read means and drives and displays a display dot corresponding to the gradation information in display gradation represented by the gradation information on the basis of the stored gradation information. For this reason, since the gradation information read means can loads only the gradation information representing intermediate gradation from the gradation information storage means without referring to all the regions of the gradation information storage means, a current consumed in the data transfer between the gradation information storage means and the display means can be held down when a display is performed by the display means.

According to the present invention, there is provided a display control device characterized by comprising: gradation information storage means for storing, in correspondence with each display dot of display means constituted by a plurality of display dots, gradation information representing display gradation of the display dot; first presence/absence information storage means for storing, with respect to first divided regions obtained by dividing a storage region of the gradation information storage means into a plurality of regions, first presence/absence information representing a first predetermined value in correspondence with each first divided region when at least one piece of gradation information stored in the first divided regions represents intermediate gradation; second presence/absence information storage means for storing, with respect to second divided regions obtained by dividing a storage region of the first presence/absence information storage means into a plurality of regions, second presence/absence information representing a second predetermined value in correspondence with each second divided region when at least one piece of gradation information stored in the second divided has the first predetermined value; first presence/absence information write means for writing the first presence/absence information in the first presence/absence information storage means on the basis of the gradation information stored in the gradation information storage means; second presence/absence information write means for writing the second presence/absence information in the second presence/absence information storage means on the basis of the first presence/absence information stored in the first presence/absence information storage means; first detection means for detecting only a second divided region, in which at least one piece of stored first presence/absence information represents the first predetermined value, from the second divided regions constituting the first presence/absence information storage means on the basis of the second presence/absence information stored in the second presence/absence information storage means; second detection means for detecting only a first divided region, in which at least one piece of stored gradation information represents intermediate gradation, from the first divided regions constituting the gradation information storage means on the basis of the first presence/absence information stored in the second divided region detected by the first detection means; gradation information read means for loading only gradation information representing intermediate gradation from the first divided region detected by the second detection means and outputting the gradation information; and drive means for storing the gradation information output from the gradation information read means and driving and displaying a display dot corresponding to the gradation information in display gradation represented by the gradation information on the basis of the stored gradation information.

According to the present invention, therefore, the first presence/absence information write means writes the first presence/absence information in the first presence/absence information storage means on the basis of the gradation information stored in the gradation information storage means, and the second presence/absence information write means writes the second presence/absence information in the second presence/absence information storage means on the basis of the first presence/absence information stored in the first presence/absence information storage means. The first detection means detects only a second divided region, in which at least one piece of stored first presence/absence information represents the first predetermined value, from the second divided regions constituting the first presence/absence information storage means on the basis of the second presence/absence information stored in the second presence/absence information storage means, and the second detection means detects only a first divided region, in which at least one piece of stored gradation information represents intermediate gradation, from the first divided regions constituting the gradation information storage means on the basis of the first presence/absence information stored in the second divided region detected by the first detection means. Therefore, the gradation information read means loads only gradation information representing intermediate gradation from the first divided region detected by the second detection means and outputs the gradation information, and the drive means stores the gradation information output from the gradation information read means and drives and displays a display dot corresponding to the gradation information in display gradation represented by the gradation information on the basis of the stored gradation information. For this reason, since the gradation information read means can load only gradation information representing intermediate gradation from the gradation information storage means without referring to all the regions of the gradation information storage means, a current consumed in the data transfer between the gradation information storage means and the display means can be held down when a display is performed by the display means.

BRIEF DESCRIPTION OF THE DRAWINGS

FIG. 3 is a view for explaining the storage contents of a frame buffer and an image data storage unit in this embodiment.

DESCRIPTION OF THE PREFERRED EMBODIMENTS

Embodiments of the present invention will be described below with reference to the accompanying drawings.

Section 1. First Embodiment

Figure 1:
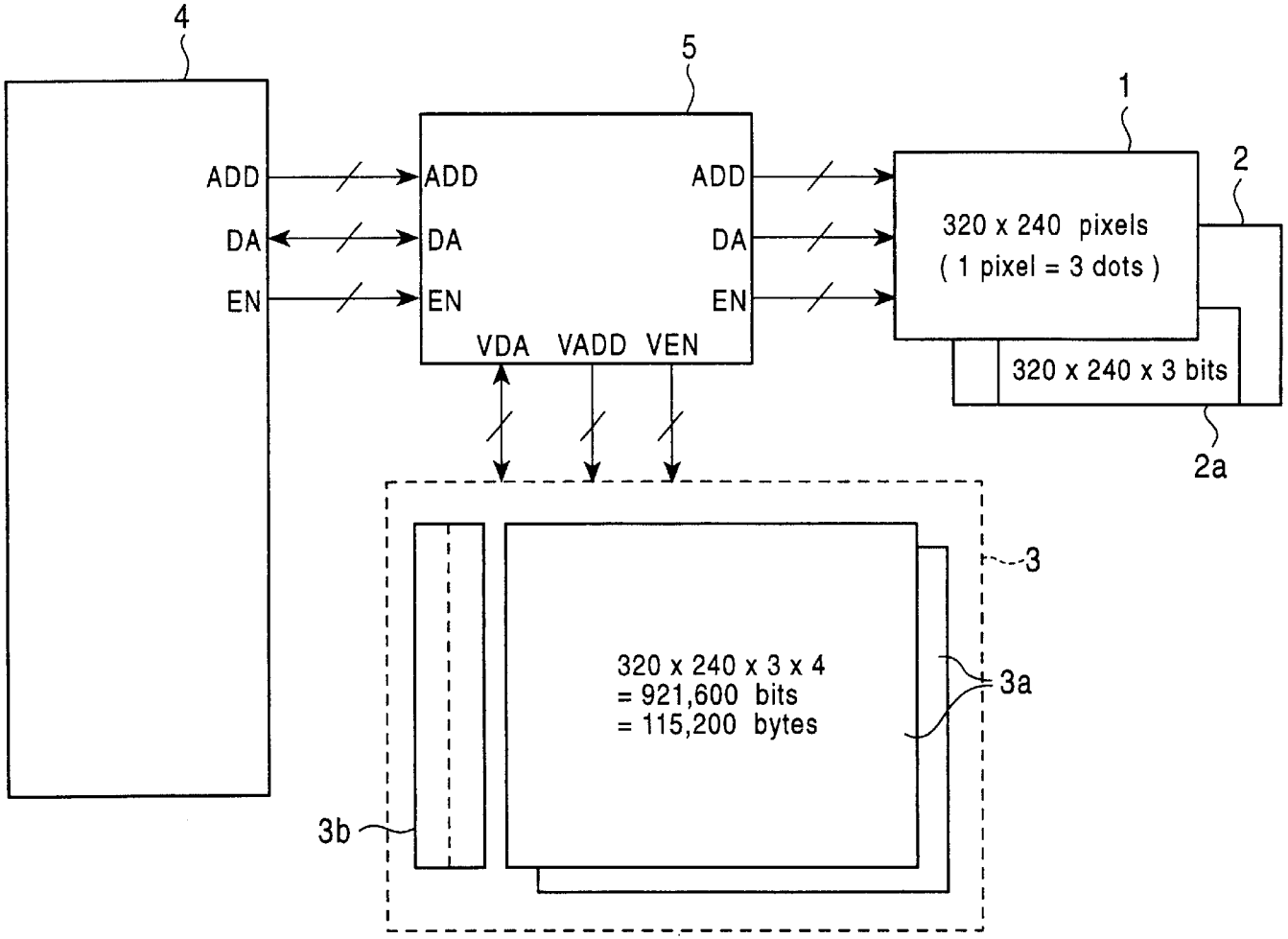
FIG. 1 is a block diagram showing an arrangement of a display device according to the first embodiment of the present invention.

FIG. 1 is a block diagram showing an arrangement of a display device according to the first embodiment of the present invention.

Figure 9:
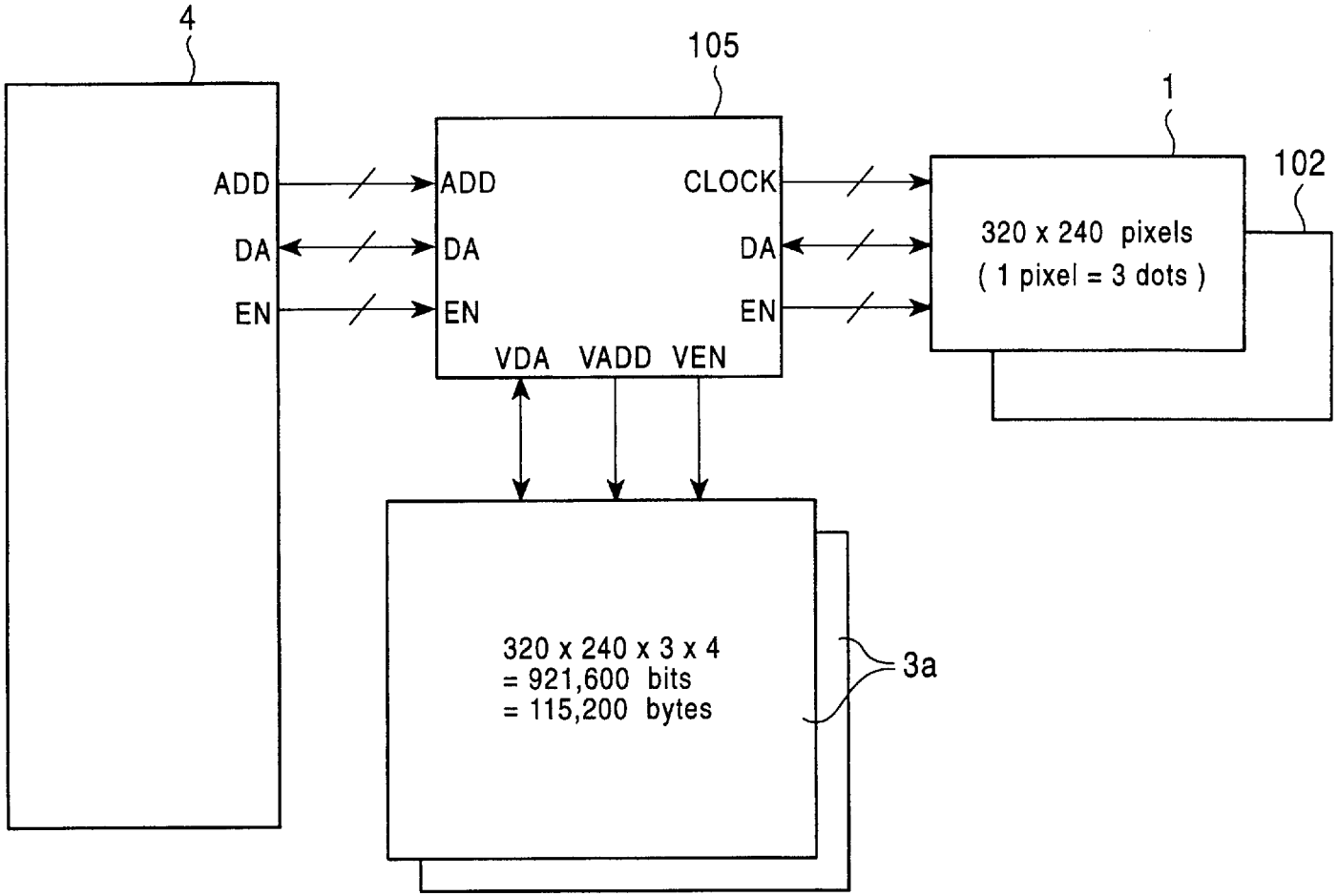
FIG. 9 PRIOR ART
FIG. 9 is a block diagram showing an arrangement of a conventional display device.

Referring to FIG. 1, an LCD panel 1 is the same as shown in FIG. 9. Each pixel of the LCD panel 1 is designated by coordinates, i.e., "pixel (m,n)" (m is an integer defined by $1 \leqq m \leqq 320$; n is an integer defined by $1 \leqq n \leqq 240$).

A driver 2 has a built-in memory 2*a*. The storage capacity of the built-in memory 2*a* is 320×240×3=230,400 bits=28,800 bytes, and these bits are allocated to the display dots (320×240×3 dots) of the LCD panel 1, respectively. The driver 2 drives each display dot to an ON state or an OFF state on the basis of the storage contents of the built-in memory 2*a*. More specifically, in the built-in memory 2*a*, if data (1 bit) corresponding to 1 dot on the LCD panel 1 is (1)2, the driver 2 sets the display dot in an ON state. If the data is (0)2, the driver 2 sets the display dot in an OFF state.

A VRAM 3 is constituted by an image data storage unit 3*a* and a frame buffer 3*b*.

The image data storage unit 3*a* has a storage capacity of 320×240×3×4=921,600 bits=115,200 bytes. In this embodiment, 4 bits of the image data storage unit 3*a* are allocated to each of the display dots (320×240×3 dots) of the LCD panel 1. In each display dot, a gradation display having 16 gradation levels, i.e., (0000)2 to (1111)2, can be performed.

As the image data storage unit 3*a*, two image data storage units having the same arrangement are arranged. One of the image data storage units is used as a display memory (front screen), and the other is used as a screen updating memory (rear screen). The present invention can also be applied to a case wherein the image data storage unit 3*a* is arranged for one screen or a case wherein the image data storage unit 3*a* is arranged for three screens.

On the other hand, the frame buffer 3*b* has a storage capacity of 2×240=480 bits=60 bytes, and two bits are allocated to each of the rows (240 rows) of the LCD panel 1.

In this embodiment, each row (320 pixels) of the LCD panel 1 is divided into two left and right portions each having 160 pixels. The bits (480 bits) of the frame buffer 3*b* are allocated to the 480 (=2×240) divided regions obtained by dividing the rows, respectively. By using an operation (to be described later) of a controller 5, in each bit of the frame buffer 3*b*, the presence/absence of intermediate gradation in a divided region corresponding to the bit is written.

Subsequently, assume that data (1 bit) corresponding to pixels (1,n) to (160,n) of the LCD panel 1 is called an "nth left bit" and that data (1 bit) corresponding to pixels (161,n) to (320,n) is called an "nth right bit".

The CPU 4 writes arbitrary image data in the image data storage unit 3*a* through the controller 5 in accordance with a program or an external input.

The controller 5 refreshes the image data storage unit 3*a* in synchronism with a pulse signal (frame signal) input at an interval of 1/150 sec, and transfers the image data stored in the image data storage unit 3*a* to the driver 2. The operation of the controller 5 will be described later.

The controller 5 has a refresh flag (1 bit: which is not illustrated) formed therein. When a write operation of image data in the image data storage unit 3*a* is completed, the CPU 4 sets the refresh flag to (1)2 to notify the controller 5 that the write operation is completed.

An operation of the display device with the above arrangement will be described below.

Figure 2A:
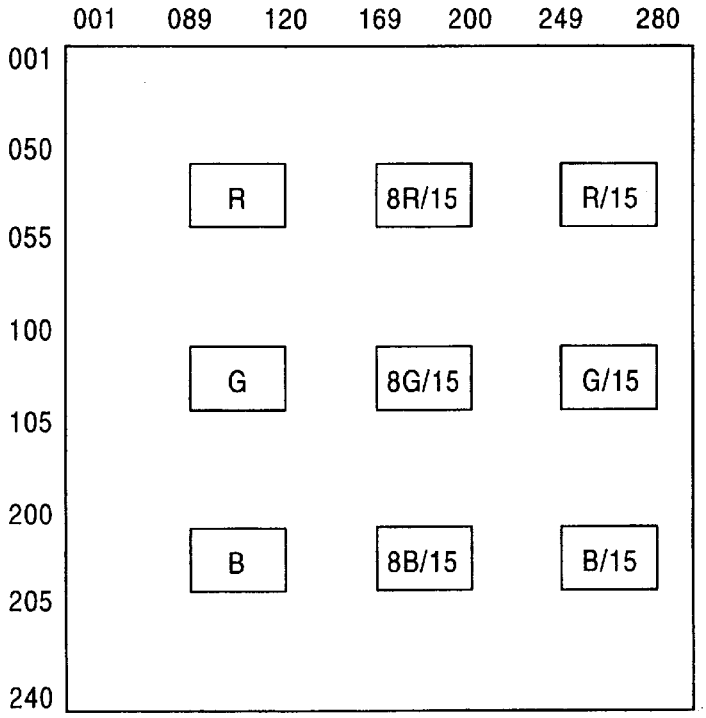
FIG. 2A is a view for explaining a gradation display of the LCD panel of an LCD panel.

The display principle of gradation in this embodiment will be described first. FIG. 2A is a view for explaining a gradation display of the LCD panel 1, and FIG. 2B is a view for explaining a process in this embodiment when the gradation display shown in FIG. 2A is performed.

Here, numbers shown in FIG. 2A represent coordinates of corresponding pixels.

Reference symbol "R" shown in FIG. 2A indicates that a square display region having a pixel (89,50) and a pixel (120,55) as diagonal points is displayed as a red region at a gradient of 100%. Similarly, "8R/15" indicates that the display region is displayed as a red region at a gradient of 8/15 (≈53%), and "R/15" indicates that the display region is displayed as a red region at a gradient of 1/15 (≈7%). With respect to reference symbols "G" (green display) and "B" (blue display) shown in FIG. 2A, indication is performed in the same manner as that of the reference symbol "R".

Figure 2B:
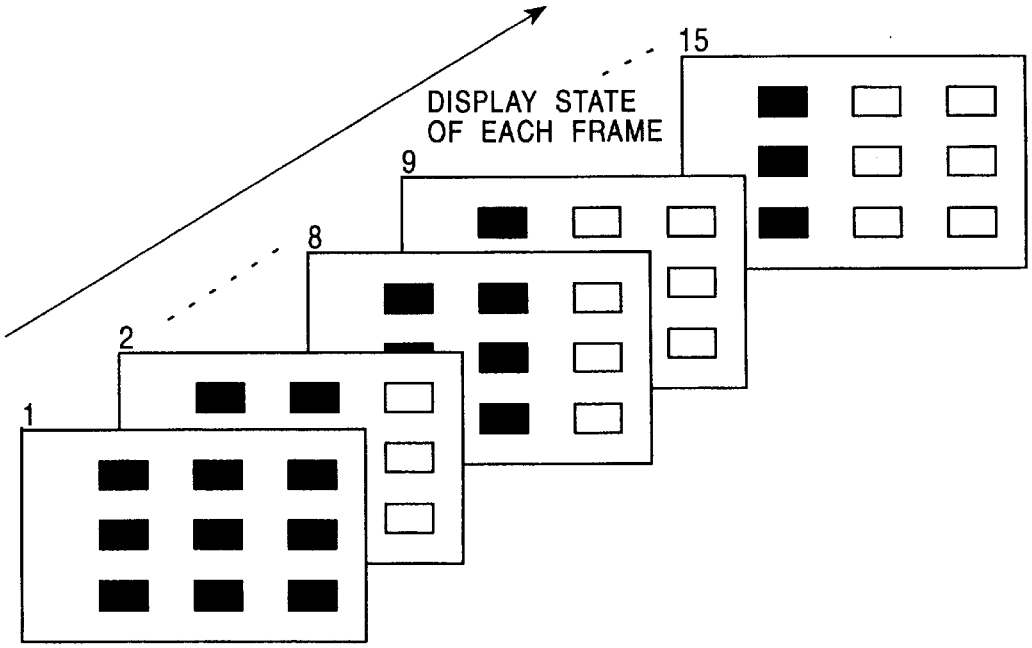
FIG. 2B is a view for explaining a process performed when the gradation display shown in FIG. 2A is performed.

On this other hand, each frame (first frame to 15th frame) shown in FIG. 2B indicates a display state of the LCD panel 1 for a predetermined extremely short time (i.e., 1/150 sec). In this embodiment, 15 frames are continuously, sequentially, and repetitively displayed, thereby constituting one display screen. At this time, 15 frames are sequentially displayed at intervals of 1/150 sec. Therefore, in this embodiment, 10 screens (one screen constituted by 15 frames) are displayed for 1 sec.

Nine ■ or □ shown in each frame in FIG. 2B correspond to display regions shown at the same position in FIG. 2A, respectively. However, ■ indicates that all the display dots in the display region are set in an ON state, and □ indicates that all display dots in the display region are set in an OFF state.

As shown in FIG. 2B, according to this embodiment, one screen is constituted by 15 frames, and gradation of the display dots in one screen is determined depending on the ratio of the number of ON display dots in the 15 frames to the number of OFF display dots in the 15 frames.

For example, when red is displayed at a gradient of 15/15 (=100%) as in the display region "R" in FIG. 2A, as shown in FIG. 2B, corresponding display dots are set in an ON state (■) in all the frames.

When red is displayed at a gradient of 8/15 (≈53%) as in the display region "8R/15" in FIG. 2A, as shown in FIG. 2B, corresponding dots are set in an ON state (■) in the first to eighth frames, and corresponding display dots are set in an OFF state (□) in the ninth to 15th frames.

When red is displayed at a gradient of 1/15 (≈7%) as in the display region "R/15" in FIG. 2A, as shown in FIG. 2B, corresponding dots are set in an ON state (■) in the first frame, and corresponding display dots are set in an OFF state (□) in the second to 15th frames.

As described above, according to this embodiment, each bit of the built-in memory 2*a* of the driver 2 and each display dot of the LCD panel 1 have a one-to-one correspondence. The storage contents of each bit of the built-in memory 2*a*, i.e., (1)2 or (0)2, directly represent the display state (ON state or OFF state) of a corresponding display dot of the LCD panel 1. For this reason, when each bit of the built-in memory 2*a* is updated to (1)2 or (0)2 at a timing equal to the display timing of each frame shown in FIG. 2B, a gradation display having 16 gradation levels can be performed.

The above is the explanation of the principle of the gradation display in this embodiment.

In this embodiment, as shown in FIG. 2B, a gradient is determined by a ratio of an ON state to an OFF state in the 15 frames, and the driver 2 has the built-in memory 2*a* for storing the states of the respective display dots in units of dots. For this reason, when the gradient of the display dot is 100% (15/15) or 0% (0/15), and a value (1)2 or (0)2 is written in a corresponding bit in the built-in memory 2*a* once, this value is held. Subsequently, the driver 2 can continuously perform a display at the gradient (100% or 0%) without receiving data from the controller 5.

Even if the gradation of a display dot is intermediate (gradient higher than 0% and lower than 100%), a value (1)2 or (0)2 written in the built-in memory 2*a* of the driver 2 is held until a next value is written in the built-in memory 2*a*. For this reason, after the value (1)2 is written in the first frame at the first, the value (0)2 is written at a timing (i.e., frame number) corresponding to the intermediate gradation. In this manner, the radio of an ON state to an OFF state in the 15 frames, i.e., a gradient, can be freely determined. More specifically, in this embodiment, even if the gradation of a display dot is intermediate, when values (1)2 and (0)2 are written once at most in the 15 frames (i.e., for 1/10 sec), intermediate-gradation display can be performed.

As described above, in this embodiment, in order to express gradation, the storage contents of the built-in memory 2*a* of the driver 2 may be updated at a timing equal to a display timing of each frame (i.e., in synchronism with a frame signal).

An updating operation, for the built-in memory 2*a*, which is performed by the controller 5 will be described below.

When an initial display of a screen is performed immediately after a power supply is turned on, the CPU 4 writes image data to be displayed, through the controller 5, in one (display memory) of the two image data storage units 3*a* arranged in the VRAM 3. Upon completion of writing operation of all the image data, the CPU 4 sets the refresh flag in the controller 5 to (1)2.

When a screen which is being displayed is to be changed, the CPU 4 writes image data to be displayed, through the controller 5, in the other (screen updating memory) of the two arranged image data storage units 3*a*. Upon completion of writing operation of all the image data, the CPU 4 sets the refresh flag in the controller 5 to (1)2 at an actual screen switching timing. Also, the image data can be directly written in the display memory of the image data storage units 3*a*.

FIG. 3 is a view for explaining the storage contents of the frame buffer 3*b* and the image data storage unit 3*a* in this embodiment. When a display shown in FIG. 2A is performed on the LCD panel 1 as a concrete example, each data shown in FIG. 3 is written in accordance with the display.

Here, in FIG. 3, each number arranged around a memory indicates the coordinates of a corresponding pixel.

As described above, the frame buffer 3*b* has a storage capacity of 2×240 bits, and 2 bits are allocated to each of the rows (320 pixels) of the LCD panel 1. The image data storage unit 3*a* has a storage capacity of 320×240×3×4 bits, and 4 bits are allocated to each of the display dots (320×240×3 dots) of the LCD panel 1.

As described above, in this embodiment, each row (320 pixels) of the LCD panel 1 is divided into two left and right portions each having 160 pixels to form 480 (=2×240) divided regions. The bits (480 bits) of the frame buffer 3*b* are allocated to the 480 divided regions, respectively. For this reason, this correspondence therebetween is also established between the frame buffer 3*b* and the image data storage unit 3*a*. A broken line shown in FIG. 3 indicates this correspondence.

Upon completion of writing operation of image data by the CPU 4, when the refresh flag is set to (1)2, the controller 5 performs the following gradation data transfer process and the write process for the frame buffer 3*b* in synchronism with the input of a frame signal.

The controller 5 loads gradation data (4-bit data) corresponding to a red dot of the pixel (1,1) from the image data storage unit (to be referred to as an "image data storage unit" hereinafter) 3*a,* in which image data is updated by the CPU 4, of the two arranged image data storage units 3*a*. In the example shown in FIG. 3, in data (000)16 stored at coordinates (001,001) of the image data storage unit 3*a,* "0" (at the left end) of the three "0"s corresponds to the gradation data of the red dot of the pixel (1,1).

The controller 5 performs a transfer process (to be described later) to the built-in memory 2*a* of the driver 2.

The controller 5 performs a loading process and a transfer process for gradation data corresponding to the green dot of the pixel (1,1) in accordance with the same procedure as described above.

Furthermore, the controller 5 performs a loading process and a transfer process for gradation data corresponding to the blue dot of the pixel (1,1) in accordance with the same procedure as described above.

Subsequently, the controller 5 also performs a loading process and a transfer process for gradation data corresponding to the display dots (R, G, and B) constituting each of the pixels (2,1) to (160,1) in accordance with the same procedure as described above.

At this time, when gradation data corresponding to at least one dot of all the dots (3×160=480 dots) constituting the pixels (1,1) to (160,1) is not (0)16 or (F)16, in the frame buffer 3*b,* the controller 5 writes (1)2 in bits corresponding to these pixels, i.e., the left bits of the first row.

In the example shown in FIG. 3, since all dots constituting the pixels (1,1) to (160,1) of the image data storage unit 3*a* have gradation data of (0)16, the controller 5 sets the left bit of the first row as (0)2 in the frame buffer 3*b*.

The controller 5 performs a loading process and a transfer process for gradation data corresponding to the display dots (R, G, and B) constituting pixels on the right half of the first row, i.e., the pixels (160,1) to (320,1), to the pixels in the same manner as described above. The controller 5 writes (1)2 or (0)2 in the right bits of the first row of the frame buffer 3*b* on the basis of the gradation data.

The above processes for the pixel group of the first row, i.e., the respective pixels (1,1) to (320,1), are concluded.

Upon completion of the processes for the pixel group of the first row, in accordance with the same procedure as described above, the controller 5 performs a loading process and a transfer process for gradation data corresponding to the display dots (R, G, and B) constituting the pixel group of the second row, i.e., the pixels (1,2) to (160,2) and (161,2) to (320,2), and performs a write process for the gradation data in the frame buffer 3*b*.

The controller 5 sequentially performs the same processes as described above to the pixel groups of the third to 240th rows.

Here, for example, in the example shown in FIG. 3, a display dot corresponding to red, of three dots constituting the pixel (169,50) of the image data storage unit 3*a* has gradation data of (8)16. For this reason, the controller 5 sets the right bit of the 50th row to (1)2 in the frame buffer 3*b*.

When the transfer process for the gradation data to the driver 2 and the write process in the frame buffer 3*b* are completed in accordance with the above procedure, the controller 5 repeats an updating process for the storage contents of the built-in memory 2*a* (to be described below) in synchronous with a frame signal until next image data is written (updated) by the CPU 4.

As described above, in this embodiment, 15 frames are continuously, sequentially, repetitively displayed to constitute one display screen. As described above, a frame signal is a pulse signal input at an interval of 1/150 sec.

More specifically, when a frame signal is input to the controller 5, the controller 5 performs a transfer process for image data (to be described below) a time (1/150 sec) before a next frame signal is input to the controller 5. When the next frame signal is input to the controller 5, the controller 5 similarly performs a transfer process for image data with respect to the (t+1)th frame. Each time a frame signal is input to the controller 5, processes for respective frames are sequentially performed. As a matter of course, after the process for the 15th frame is performed, the process for the first frame is performed again.

When the first frame signal is input to the controller 5, the controller 5 starts the process for the first frame.

Here, the controller 5 sequentially and continuously loads the data (1 bit) of the left bit of the first row, the right bit of the first row, the left bit of the second row, the right bit of the second row, the left bit of the third row, . . . , until (1)2 is loaded from the frame buffer 3*b*.

When the data of the left bit of the nth row in the frame buffer 3*b* is (1)2, the controller 5 loads gradation data (4 bits) corresponding to the red dot of a pixel (1,n) from the image data storage unit 3*a*. (In contrast to this, for example, when the data of the right bit of the nth row is (1)2, gradation data corresponding to the red dot of a pixel (161,n)).

When the gradation data is (0)16 or (F)16, the controller 5 does not perform a transfer process. On the other hand, when the gradation data is not (0)16 or (F)16, the controller 5 performs a transfer process (to be described later) to the built-in memory 2*a* of the driver 2 on the basis of the gradation data (and its address).

The controller 5 loads gradation data (4 bits) corresponding to the green dot of the same pixel from the image data storage unit 3.

When the gradation data is (0)16 or (F)16, the controller 5 does not perform a transfer process. On the other hand, when the gradation data is not (0)16 or (F)16, the controller 5 performs a transfer process (to be described later) to the built-in memory 2*a* of the driver 2 on the basis of the gradation data (and its address).

Finally, the controller 5 loads the gradation data (4 bits) corresponding to the blue dot of the pixel from the image data storage unit 3*a*.

When the gradation data is (0)16 or (F)16, the controller 5 does not perform a transfer process. On the other hand, when the gradation data is not (0)16 or (F)16, the controller 5 performs a transfer process (to be described later) to the built-in memory 2*a* of the driver 2 on the basis of the gradation data (and its address).

Subsequently, the controller 5 performs a loading process for the gradation data to the display dots (R, G, and B) constituting the pixels (2,n) to (160,n) in accordance with the same procedure as described above, and the controller 5 performs a transfer process for the gradation data if necessary.

Upon completion of the process for the pixel (160,n), the controller 5 continues a loading process from the frame buffer 3*b* from the next bit (in this case, the right bit of the nth row) again.

The above operations are continuously performed, and a loading process from the last bit (right bit of the 240th row) of the frame buffer 3*b* and the process based on the data are completed. At this time, the processes for the first frame are concluded.

When the next frame signal is input to the controller 5, the controller 5 performs processes for the second frame in the same procedure as for the first frame. Each time a frame signal is input to the controller 5, the controller 5 sequentially repeats the same processes as described above for the frames while a frame number to be processed increments.

The above is the explanation of the updating operation, for the built-in memory 2*a,* performed by the controller 5.

A transfer process, for gradation data, performed by the controller 5 will be described below.

In this embodiment, it is determined, on the basis of the frame number (first frame to fifth frame) of a frame which is being processed and gradation data loaded from the image data storage unit 3*a,* whether a transfer process to the built-in memory 2*a* is performed or not.

More specifically, when the gradation data (gradation data loaded from the image data storage unit 3*a*) is (0)16, the controller 5 transfers (0)2 if the frame which is being processed is the first frame, and the controller 5 transfers no data if the frame is one of the second frame to the 15th frame.

When the gradation data is (1)16, the controller 5 transfers (1)2 if the frame which is being processed is the first frame. The controller 5 transfers (0)2 if the frame is the second frame, and the controller 5 transfers no data if the frame is one of the third frame to the 15th frame.

Assume that the gradation data is selected from (2)16 to (D)16. In this case, when the gradation data is set to (p)16, the controller 5 transfers (1)2 if the frame which is being processed is the first frame. The controller 5 transfers no data if the frame is one of the second frame to the pth frame, the controller 5 transfers (0)2 if the (p+1)th frame, and the controller 5 transfers no data if the frame is one of the (p+2)th frame to the 15th frame.

When the gradation data is (E)16, the controller 5 transfers (1)2 if the frame which is being processed is the first frame. The controller 5 transfers no data if the frame is one of the second frame to the 14th frame, and the controller 5 transfers (0)2 if the frame is the 15th frame.

When the gradation data is (F)16, the controller 5 transfers (1)2 if the frame which is being processed is the first frame, and the controller 5 transfers no data if the frame is one of the second frame to the 15th frame.

When the data (1)2 or (0)2 is to be transferred, the data is transferred together with the address (coordinate data on the LCD panel 1) of the corresponding gradation data. On the basis of this address, the driver 2 updates the data of a corresponding bit to the transferred data (1)2 or (0)2 in the built-in memory 2*a*.

The explanation of the operation of the display device with the above arrangement is concluded.

As described above, according to this embodiment, data transfer to the driver 2 may be performed with respect to only a display dot having intermediate gradation (1/15 to 14/15) as a gradient.

In this embodiment, each row (320 pixels) of the LCD panel 1 is divided into two left and right portions each having 160 pixels to form 480 (=2×240) divided regions. The bits (480 bits) of the frame buffer 3*b* are allocated to the 480 divided regions, respectively, and (1)2 is stored in a bit corresponding to a divided region (i.e., the left half of the nth row or the right half of the nth row) having an intermediate-gradation pixel (having a display dot).

Therefore, the controller 5 can find gradation data corresponding to the intermediate-gradation display dot from the image data storage unit 3*a* with reference to the storage contents of the frame buffer 3*b* without referring to all the gradation data of the image data storage unit 3*a*.

For this reason, according to this embodiment, an amount of gradation data read from the image data storage unit 3*a* and an amount of data to be transferred to the driver 2 can be made considerably smaller than those of a conventional device.

Section 2. Second Embodiment

Figure 4:
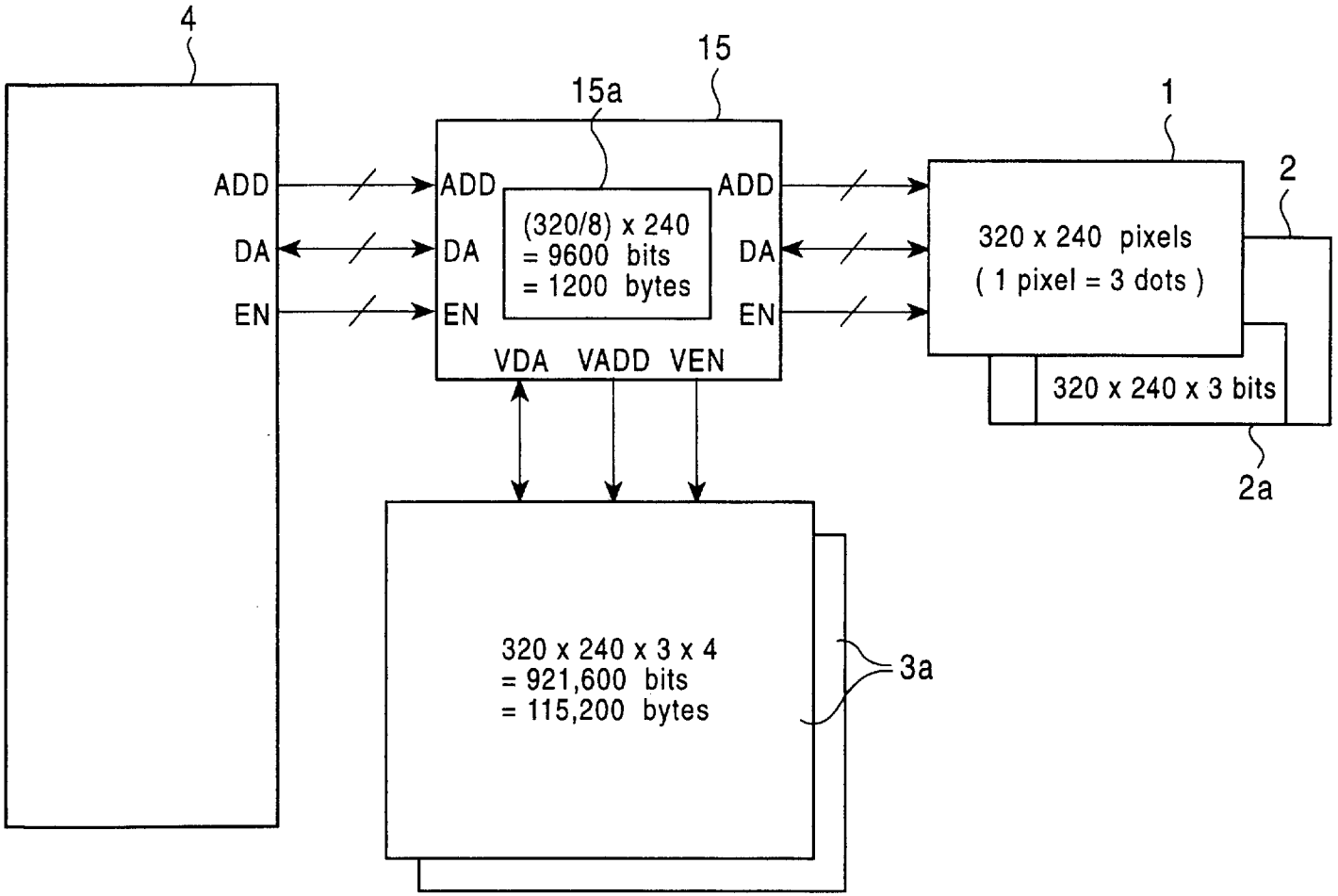
FIG. 4 is a block diagram showing an arrangement of a display device according to the second embodiment of the present invention.

FIG. 4 is a block diagram showing an arrangement of a display device according to the second embodiment of the present invention. The same reference numerals as in FIG.

1 denote the same parts in FIG. 4, and a description thereof will be omitted.

In the display device shown in FIG. 4, a controller 15 is arranged in place of the controller 5.

As in the controller 5 shown in FIG. 1, the controller 15 refreshes an image data storage unit 3*a* in synchronism with a pulse signal (frame signal) input at an interval of 1/150 sec, and transfers the image data stored in the image data storage unit 3*a* to a driver 2. The operation of the controller 15 will be described later.

The controller 15 has a refresh flag (1 bit: which is not illustrated) formed therein as in the controller shown in FIG. 1. When a write operation of image data in the image data storage unit 3*a* is completed, the CPU 4 sets the refresh flag to (1)2 to notify the controller 5 that the write operation is completed.

The controller 15 has a cache memory 15*a* formed therein. The cache memory 15*a* has a storage capacity of (320/8)×240=40×240=9,600 bits=1,200 bytes.

In this embodiment, each row (320 pixels) of an LCD panel 1 is divided into 40 portions each having 8 pixels to form 9,600(=40×240) divided regions. The bits (9,600 bits) of the cache memory 15*a* are allocated to the divided regions, respectively. By using an operation (to be described later) of the controller 15, in each bit of the cache memory 15*a,* the presence/absence of intermediate gradation is written.

In the following description, assume that, in the cache memory 15*a,* data (1 bit) corresponding to pixels (k,n) to (k+7,n) of the LCD panel 1 is designated by coordinates, e.g., "data of bit coordinates (i,n)", (where, i is an integer defined by $1 \leqq i \leqq 40$, and $k=(i-1)\times 8+1$ is established).

An operation of the display device with the above arrangement will be described below.

Since the display principle of gradation in this embodiment is the same as that in the first embodiment (FIGS. 2A and 2B), a description thereof will be omitted. More specifically, in this embodiment, in order to express gradation, the storage contents of a built-in memory 2*a* of the driver 2 may be updated at a timing equal to a display timing of each frame (i.e., in synchronism with a frame signal).

An updating operation, for the built-in memory 2*a,* which is performed by the controller 15 will be described below.

When an initial display of a screen is performed immediately after a power supply is turned on, the CPU 4 writes image data to be displayed, through the controller 15, in one (display memory) of the two arranged image data storage units 3*a*. Upon completion of writing operation of all the image data, the CPU 4 sets the refresh flag in the controller 15 to (1)2.

When a screen which is being displayed is to be changed, the CPU 4 writes image data to be displayed, through the controller 15, in the other (screen updating memory) of the two arranged image data storage units 3*a*. Upon completion of writing operation of all the image data, the CPU 4 sets the refresh flag in the controller 15 to (1)2 at an actual screen switching timing.

Figure 5:
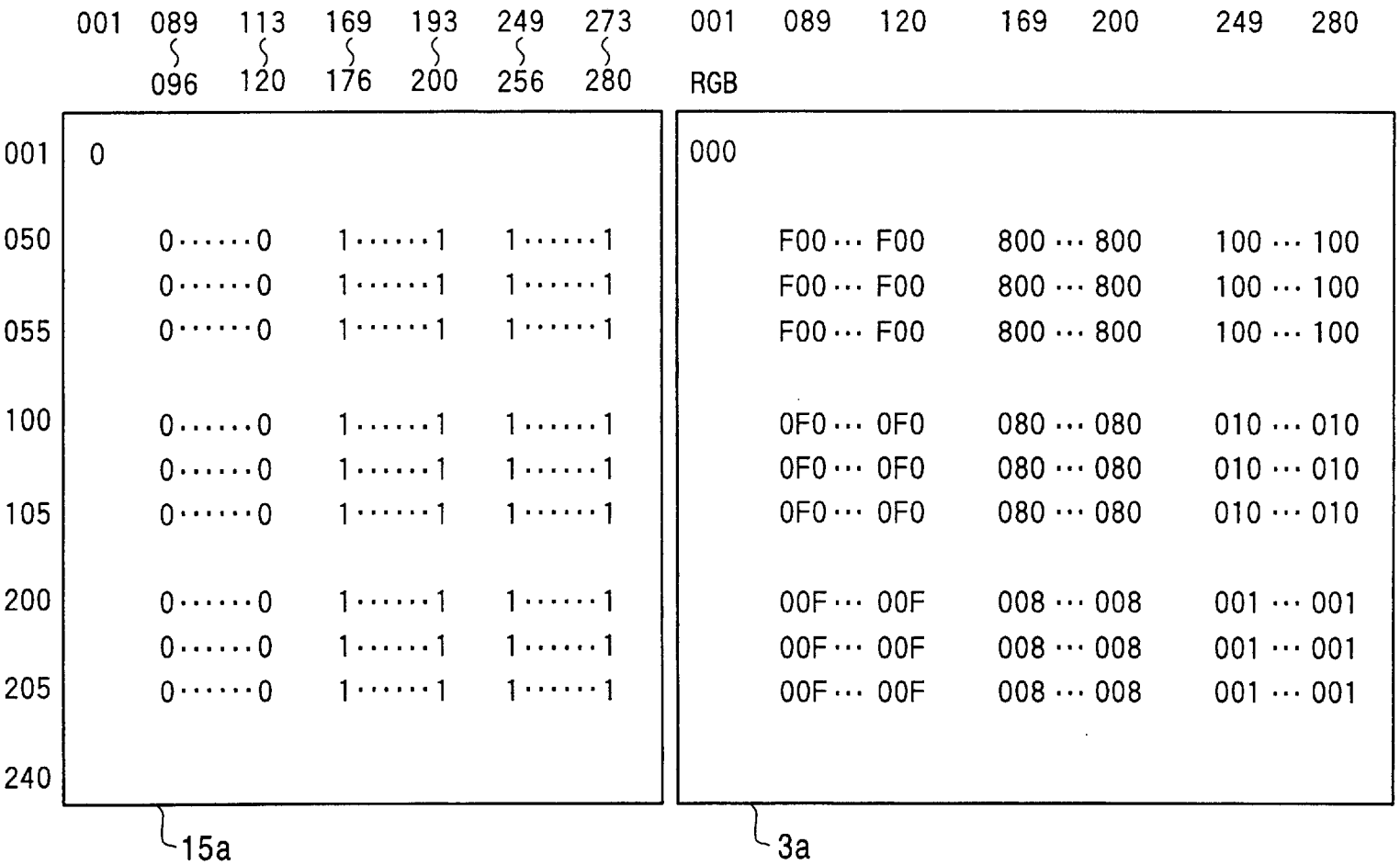
FIG. 5 is a view for explaining the storage contents of a cache memory and an image data storage unit in this embodiment.

FIG. 5 is a view for explaining the storage contents of the cache memory 15*a* and the image data storage unit 3*a* in this embodiment. When a display shown in FIG. 2A is performed on the LCD panel 1 as a concrete example, each data shown in FIG. 5 is written in accordance with the display.

Here, in FIG. 5, each number arranged around a memory indicates the coordinates of a corresponding pixel. For example, the numbers "089 to 096" shown in FIG. 5 indicate that eight pixels at the coordinates (89,n) to (96,n) on the LCD panel 1 correspond to 1-bit data of the cache memory 15*a*.

As described above, the cache memory 15*a* has a storage capacity of 40×240 bits, and 40 bits are allocated to the rows (320 pixels) of the LCD panel 1, respectively. The image data storage unit 3*a* has a storage capacity of 320×240×3×4 bits, and 4 bits are allocated to each of the display dots (320×240×3 dots) of the LCD panel 1.

As described above, in this embodiment, each row (320 pixels) of the LCD panel 1 is divided into 40 portions each having 8 pixels to form 9,600 divided regions (=40×240). The bits (9,600 bits) of the cache memory 15*a* are allocated to the 9,600 divided regions, respectively. For this reason, this correspondence therebetween is also established between the cache memory 15*a* and the image data storage unit 3*a*.

Upon completion of writing operation of image data by the CPU 4, when the refresh flag is set to (1)2, the controller 15 performs the following gradation data transfer process and the write process for the cache memory 15*a* in synchronism with the input of a frame signal.

The controller 15 loads gradation data (4-bit data) corresponding to a red dot of a pixel (1,1) from the image data storage unit (to be referred to as an "image data storage unit" hereinafter) 3*a*, in which image data is updated by the CPU 4, of the two arranged image data storage units 3*a*. In the example shown in FIG. 5, in data (000)16 stored at coordinates (001,001) of the image data storage unit 3*a*, "0" (at the left end) of the three "0"s corresponds to the gradation data of the red dot of the pixel (1,1).

The controller 15 performs a transfer process (to be described later) to the built-in memory 2*a* of the driver 2. Since the transfer process, for gradation data, which is performed by the controller 15 is the same as the transfer process by the controller 5 described in the first embodiment, a description thereof will be omitted.

The controller 15 performs a loading process and a transfer process for gradation data corresponding to the green dot of the pixel (1,1) in accordance with the same procedure as described above.

Furthermore, the controller 15 performs a loading process and a transfer process for gradation data corresponding to the blue dot of the pixel (1,1) in accordance with the same procedure as described above.

Subsequently, the controller 15 also performs a loading process and a transfer process for gradation data corresponding to the display dots (R, G, and B) constituting each of, the remaining pixels of the first row, i.e., the pixels (2,1) to (320,1) in accordance with the same procedure as described above.

At this time, each time a process for each 8 pixels, i.e., pixels (1,1) to (8,1), pixels (9,1) to (16,1), pixels (17,1) to (24,1), . . . , by using each 8 pixels as one unit, when gradation data corresponding to at least one dot of all the dots (3×8=24 dots) constituting the 8 pixels is not (0)16 or (F)16, the controller 15 writes (1)2 in a corresponding bit in the cache memory 15*a*.

In the example shown in FIG. 5, since all dots constituting the pixels (1,1) to (8,1) of the image data storage unit 3*a* have gradation data of (0)16, the controller 15 sets the data of the bit coordinates (1,1) in the cache memory 15*a*.

The above processes for each pixel of the pixel group of the first row, i.e., the pixels (1,1) to (320,1) are concluded.

Upon completion of the process for the pixel group of the first row, the controller 15 performs a loading process and a transfer process for gradation data corresponding to the display dots (R, G, and B) constituting pixels of the pixel group of the second row, i.e., the pixels (1,2) to (320,2), in the same manner as described above. The controller 15 performs a write process to the cache memory 15*a* for each 8 pixels.

The controller 15 sequentially performs the same processes as described above to the pixel groups of the third to 240th rows.

Here, for example, in the example shown in FIG. 5, a display dot corresponding to red, of three dots constituting the pixel (169,50) of the image data storage unit 3*a* has gradation data of (8)16. For this reason, the controller 15 sets data (1 bit) of the bit coordinates (22,50) to (1)2 in the cache memory 15*a*. In this case, since 169=(22−1)×8+1 is established, the pixel (169,50) on the LCD panel 1 corresponding to the bit coordinates (22,50) of the cache memory 15*a*.

When the transfer process for the gradation data to the driver 2 and the write process in the cache memory 15*a* are completed in accordance with the above procedure, the controller 15 repeats an updating process for the storage contents of the built-in memory 2*a* (to be described below) in synchronous with a frame signal until next image data is written (updated) by the CPU 4.

When the first frame signal is input to the controller 15, the controller 15 starts the process for the first frame.

Here, the controller 15 sequentially and continuously loads the data (1 bit) of the bits of bit coordinates (1,1), (2,1), (3,1), . . . , in this order until (1)2 is loaded from the cache memory 15*a*. As a matter of course, the bit coordinates (40,n) is loaded, and then the bit coordinates (1,n+1) is loaded.

For example, when the data of the bit coordinates (i,n) in the cache memory 15*a* is (1)2, the controller 15 loads gradation data (4 bits) corresponding to the red dot of a pixel ((i−1)×8+1,n) from the image data storage unit 3*a*.

When the gradation data is (0)16 or (F)16, the controller 15 does not perform a transfer process. On the other hand, when the gradation data is not (0)16 or (F)16, the controller 15 performs the above transfer process to the built-in memory 2*a* of the driver 2 on the basis of the gradation data (and its address).

Next, the controller 15 loads the gradation data (4 bits) corresponding to the green dot of the pixel from the image data storage unit 3*a*.

When the gradation data is (0)16 or (F)16, the controller 15 does not perform a transfer process. On the other hand, when the gradation data is not (0)16 or (F)16, the controller 15 performs the above transfer process to the built-in memory 2*a* of the driver 2 on the basis of the gradation data (and its address).

Finally, the controller 15 loads the gradation data (4 bits) corresponding to the blue dot of the pixel from the image data storage unit 3*a*.

When the gradation data is (0)16 or (F)16, the controller 15 does not perform a transfer process. On the other hand, when the gradation data is not (0)16 or (F)16, the controller 15 performs the above transfer process to the built-in memory 2*a* of the driver 2 on the basis of the gradation data (and its address).

Subsequently, the controller 15 performs a loading process for the gradation data to the display dots (R, G, and B) constituting the pixels ((i−1)×8+2,n) to ((i−1)×8+8,n) in accordance with the same procedure as described above, and the controller 15 performs a transfer process for the gradation data if necessary.

Upon completion of the process for the pixel ((i−1)×8+8,n), the controller 15 continues a loading process from the cache memory 15*a,* from the next bit (in this case, the bit coordinates (i+1,n)) again.

The above operations are continuously performed, and a loading process from the last bit, the bit coordinates (40,240) and the process based on the data are completed. At this time, the processes for the first frame are concluded.

When the next frame signal is input to the controller 15, the controller 15 performs processes for the second frame in the same procedure as for the first frame. Each time a frame signal is input to the controller 15, the controller 15 sequentially repeats the same processes as described above for the frames while a frame number to be processed increments.

The above is the explanation of the updating operation, for the built-in memory 2*a,* performed by the controller 15.

The explanation of the operation of the display device with the above arrangement is concluded.

As described above, according to this embodiment, data transfer to the driver 2 may be performed with respect to only a display dot having intermediate gradation (1/15 to 14/15) as a gradient.

In this embodiment, each row (320 pixels) of the LCD panel 1 is divided into 40 portions each having 8 pixels to form 9,600 (=40×240) divided regions. The bits (9,600 bits) of the cache memory 15*a* are allocated to the 9,600 divided regions, respectively, and (1)2 is stored in a bit corresponding to a divided region (i.e., a set of 8 pixels) having an intermediate-gradation pixel (having a display dot).

Therefore, the controller 5 can find gradation data corresponding to the intermediate-gradation display dot from the image data storage unit 3*a* with reference to the storage contents of the cache memory 15*a* without referring to all the gradation data of the image data storage unit 3*a*.

For this reason, according to this embodiment, an amount of gradation data read from the image data storage unit 3*a* and an amount of data to be transferred to the driver 2 can be made considerably smaller than those of conventional device.

Although the embodiments of the present invention have been described with reference to the accompanying drawings, the detailed arrangement of the invention is not limited to the embodiments. Various changes and modifications of the present invention may be effected without departing from the spirit and scope of the invention.

For example, in each of the embodiment, a loading/writing operation for data between each of memories (the built-in memory 2*a,* the VRAM 3, and the cache memory 15*a*) and the controller 5 (or 15) may be performed in units of bytes or in units of bits.

In the first embodiment, each row (320 pixels) of the LCD panel 1 is divided into two left and right portions each having 160 pixels to form 480 (=2×240) divided regions, and the bits (480 bits) of the frame buffer 3*b* are allocated to the divided regions, respectively. The dividing manner of the display screen of the LCD panel 1 and the storage capacity of the frame buffer 3*b* corresponding to the dividing manner are not limited to the example described above. For example, various combination such as the combination described below may be used. That is, the storage capacity of the frame buffer 3*b* is set to be 320×240=76,800 bits, and these bits are allocated to the pixels (320×240 pixels) of the LCD panel 1, respectively.

Similarly, the correspondence between the cache memory 15*a* and the LCD panel 1 in the second embodiment is not limited to the example described in the second embodiment.

In each of the embodiments, one screen is constituted by 15 frames, and the gradation of each of the display dots in the screen is determined depending on the ratio of ON state/OFF state in the 15 frames. However, the number of frames constituting one screen is not limited to 15, and may be smaller or larger than 15.

The correspondence between each means described in claims and the above embodiments will be described below.

| | |
|---|---|
| Gradation information ... storage means | Image data storage unit 3a |
| Presence/absence information ... storage means | Controller 5 (first embodiment)<br>Cache memory 15a (second embodiment) |
| Presence/absence information ... write means | Controller 5 (first embodiment)<br>Controller 5 (second embodiment) |
| Detection means ... | Controller 5 (first embodiment)<br>Controller 15 (second embodiment) |
| Gradation information ... read means | Controller 5 (first embodiment)<br>Controller 15 (second embodiment) |
| Drive means ... | Driver 2 |
| Display means ... | LCD panel 1 |
| Gradation information write means ... | CPU 4 |

EXAMPLE

An example related to comparison between the conventional device (see FIG. 9) and the above embodiments (see FIGS. 1 and 4) with respect to an amount of transferred data will be described below.

The conditions of this example are described below.

1 The size of the LCD panel 1 is 320 (horizontal)×240 (vertical) pixels.

2 Each pixel of the LCD panel 1 is constituted by three, red (R), green (G), and (B) blue dots.

3 In the LCD panel 1, each display dot can be displayed at 16 gradation levels (0/15 to 15/15).

4 The gradation of a ¼ portion of the display screen of the LCD panel 1 is set to be intermediate gradation having a gradient of 8/15 (≈53), and the remaining has a gradient of 0% or 100%.

5 In the conventional device and the above embodiments (first and second embodiments), the frequency of a frame signal is set to the same value (150 Hz).

The results obtained by the example under the above conditions are as follows.

(1) Conventional Device a. Amount of Data Transferred from Controller 105 to Driver 102

In the conventional device, since data (1 bit) representing the ON/OFF states of all the dots must be transferred to the driver 102 in all the frames, an amount of transferred data per screen (15 frames) is given by:

320×240×3×15=3,456,000 bits=432,000 bytes.

b. Amount of Data Transferred from Image Data Storage Unit 3*a* to Controller 105

In the conventional device, gradation data (4 bits) of all the display dots must be read from the image data storage unit 3*a* in all the frames, an amount of transferred data per screen (15 frames) is given by:

320×240×3×4×15=13,824,000 bits=1,728,000 bytes.

However, in this case, an address for designating gradation data to be read must be transferred, an actual amount of transferred data becomes twice the calculated data. That is, 1,728,000×2=3,456,000 bytes.

c. Total

When the values a. and b. are summed, an amount of transferred data per screen (15 frames) is given by:

432,000+3,456,000=3,888,000 bytes.

(2) First Embodiment a. Amount of Data Transferred from Controller 5 to Driver 2

In the first embodiment, since data (1 bit) representing the ON/OFF states of only display dots (¼ of all the dots) for performing a display in intermediate gradation may be transferred with respect to only two frames, an amount of transferred data per screen (15 frames) is given by:

320×240×3×(¼)×2=115,200 bits=14,400 bytes.

However, in the first embodiment, coordinate data (address) for designating the display dots must be transferred together with the above data. For this reason, an actual amount of transferred data becomes twice the calculated value. That is, 14,400×2=28,800 bytes.

b. Amount of Data Transferred from VRAM 3 to Controller 5

In this embodiment, the image data storage unit 3*a* is accessed on the basis of the storage contents of the frame buffer 3*b*. Here, an amount of data transferred from the frame buffer 3*b* is given by:

2×240×15=7,200 bits=900 bytes.

On the other hand, an amount of data transferred from the image data storage unit 3*a* is given by:

(320/2)×(240/2)×3×4×2=460,800 bits=57,600 bytes.

However, in this case, since an address for designating gradation data to be read must be transferred, an actual amount of transferred data is twice the calculated value. That is, 57,600×2=115,200 byte Therefore, a total amount of transferred data when the VRAM 3 is accessed is given by:

900+115,200=116,100 bytes.

c. Total

The values of a. and b. are summed, an amount of transferred data per screen (15 frames) in the first embodiment is given by:

28,800+116,100=144,900 bytes.

(3) Second Embodiment a. Amount of Data Transferred from Controller 15 to Driver 2

An amount of data transferred from the controller 15 to the driver 2 in the second embodiment is equal to the value (28,800 bytes) obtained in the first embodiment.

b. Amount of Data Transferred from Image Data Storage Unit 3*a* to Controller 15

In the second embodiment, the image data storage unit 3*a* is accessed on the basis of the storage contents of the cache memory 15*a*. Here, since the cache memory 15*a* is built in the controller 15, only an amount of data transferred from the image data storage unit 3*a* is posed as a problem in terms of a current consumption during data transfer. The amount of data transferred from the image data storage unit 3*a* is given by:

(320/2)×(240/2)×3×4×2=460,800 bits=57,600 bytes.

However, in this case, since an address for designating gradation data to be read must be transferred, an actual amount of transferred data is twice the calculated value. That is, 57,600×2=115,200 byte c. Total The values of a. and b. are summed, an amount of transferred data per screen (15 frames) in the second embodiment is given by:

28,800+115,200=144,000 bytes.

(4) Comparison Result

As described above, a total amount of transferred data per screen (15 frames) in the first embodiment is about 1/27

(≈3,888,000÷144,900) that of the conventional device. Accordingly, a current consumption also decreases.

In addition, a total amount of transferred data per screen (15 frames) in the second embodiment is about 1/27 (≈3,888,000÷144,000) that of the conventional device. Accordingly, a current consumption also decreases.

In this example, as condition 4 described above, the intermediate-gradation area is set to be ¼ the area of the display screen of the LCD panel 1. However, a difference between the current consumption of the conventional device and the current consumption of the embodiment (first or second embodiment) increases as the intermediate-gradation area decreases.

Section 3. Third Embodiment

Figure 6:
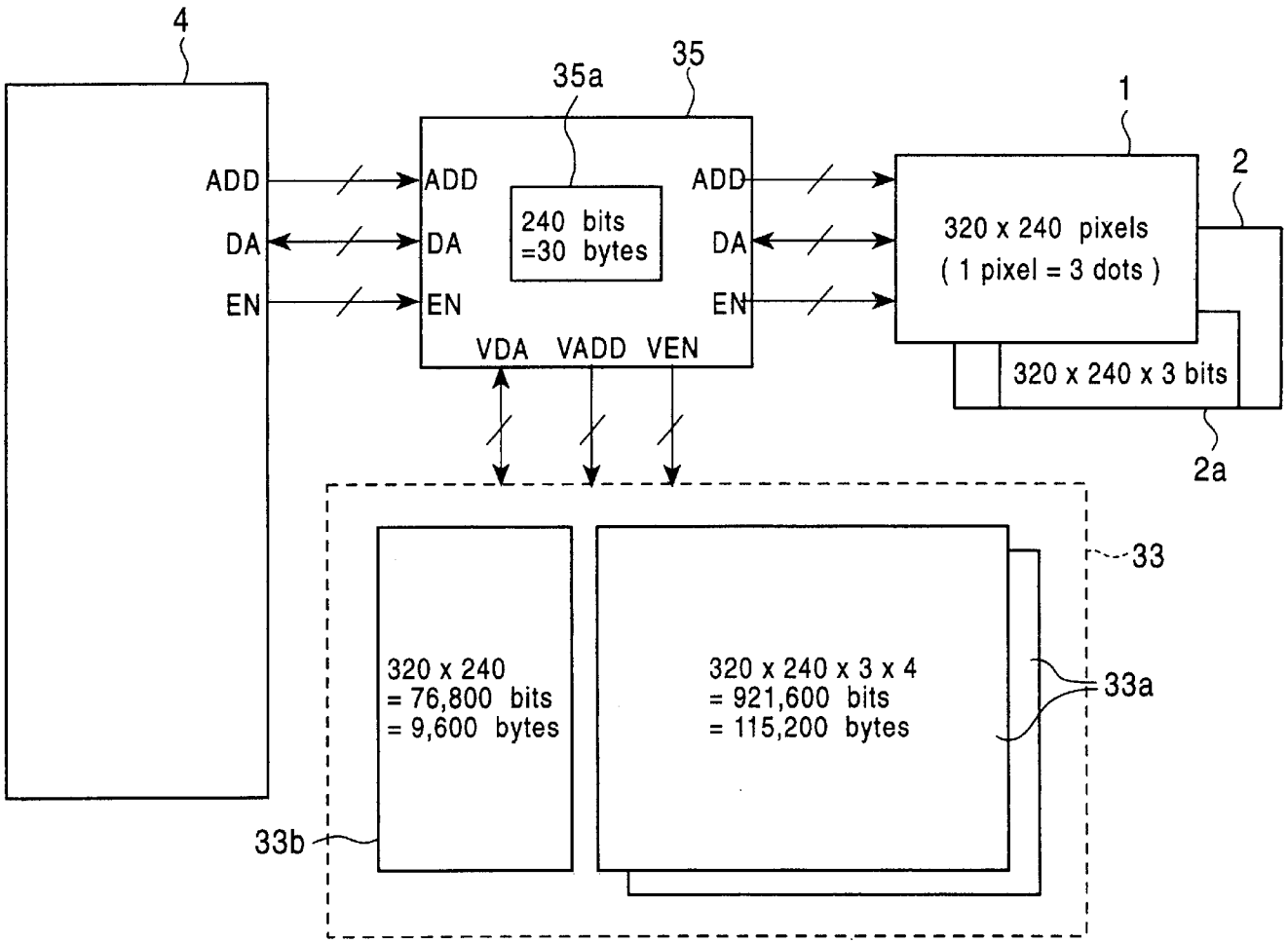
FIG. 6 is a block diagram showing an arrangement of a display device according to the third embodiment of the present invention.

FIG. 6 is a block diagram showing an arrangement of a display device according to the third embodiment of the present invention. The same reference numerals as in FIG. 1 denote the same parts in FIG. 6, and a description thereof will be omitted.

In the display device shown in FIG. 6, a controller 35 and a VRAM 33 are newly arranged.

A frame buffer 33*b* in FIG. 6 has a storage capacity of 320×240=76,800 bits=9,600 bytes, and these bits are allocated to the pixels (320×240 pixels) of an LCD panel 1, respectively. In the following description, data (1 bit) corresponding a pixel (m,n) of the LCD panel 1 is designated by coordinates, e.g., as "data of bit coordinates (m,n)".

The controller 35 has a refresh flag (1 bit: which is not illustrated) formed therein. When a write operation of image data in an image data storage unit 33*a* is completed, the CPU 4 sets the refresh flag to (1)2 to notify the controller 35 that the write operation is completed.

The controller 35 has a cache memory 35*a* formed therein. The cache memory 35*a* has a storage capacity of 240 bits=30 bytes, and these bits are allocated to the rows (240 rows) of the LCD panel 1, respectively. Here, in the cache memory 35*a*, data (1 bit) corresponding to the nth row of the LCD panel 1 is designated by a number, e.g., as "data of bit number n".

Figure 7A:
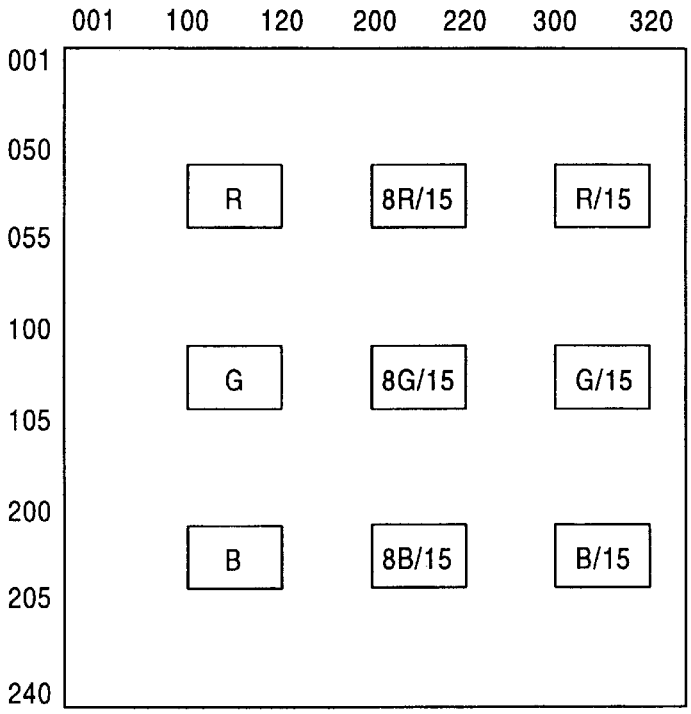
FIG. 7A is a view for explaining a gradation display of an LCD panel in this embodiment.
Figure 7B:
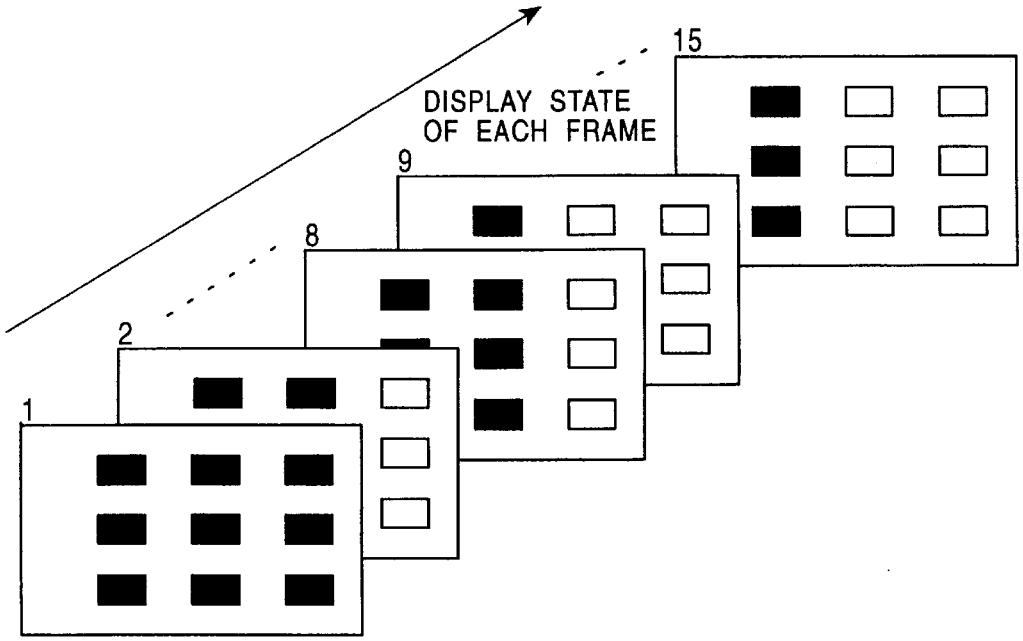
FIG. 7B is a view for explaining a process performed when the gradation display shown in FIG. 7A is performed.
Figure 8:
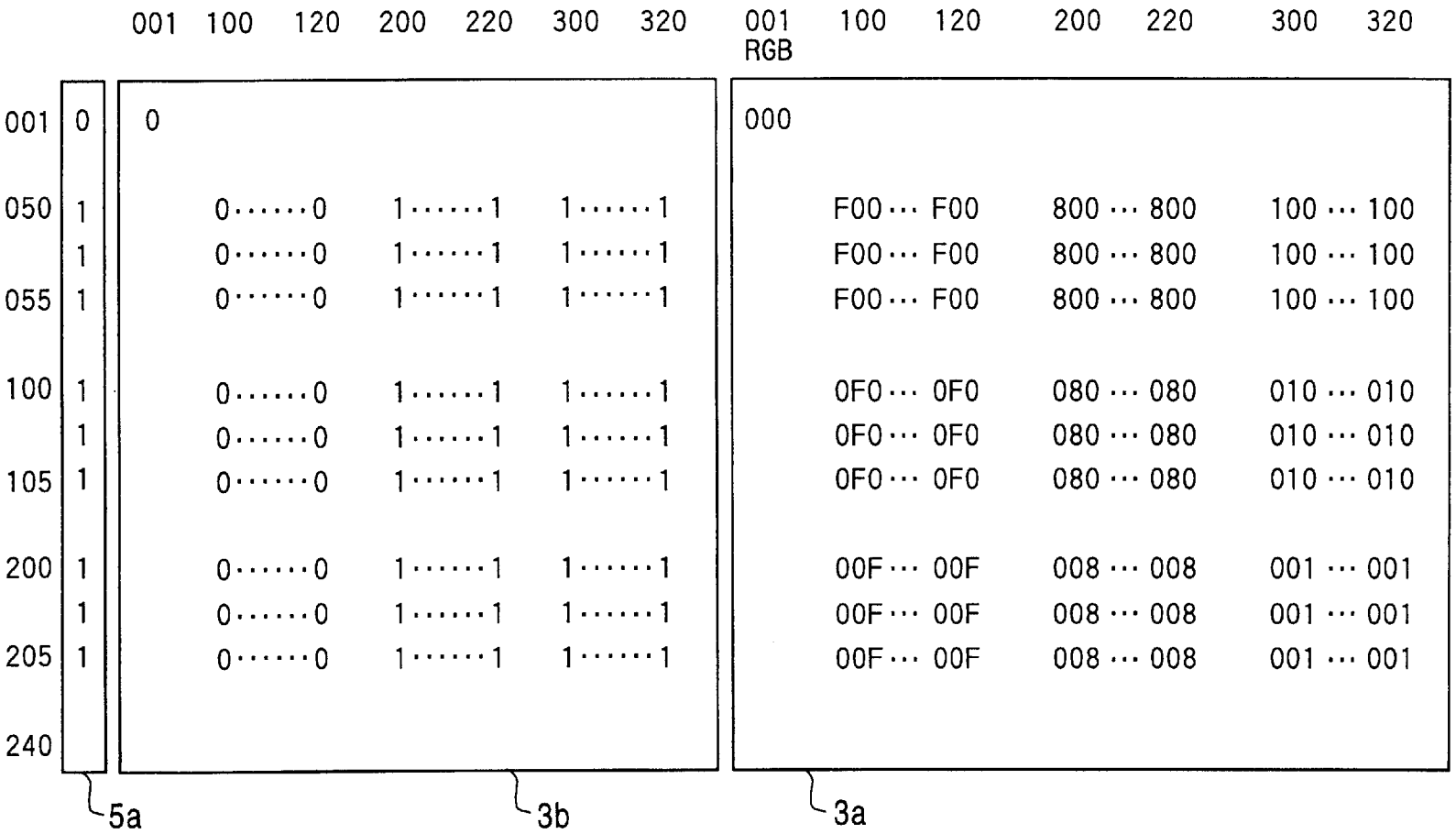
FIG. 8 is a view for explaining the storage contents of a cache memory, a frame buffer, and an image data storage unit in this embodiment.

FIG. 8 is a view for explaining the storage contents of the cache memory 35*a*, the frame buffer 33*b*, and the image data storage unit 33*a* in this device. When a display shown in FIG. 7A is performed on the LCD panel 1 as a concrete example, each data shown in FIG. 8 is written in accordance with the display.

Here, numbers (001 to 320 and 001 to 240) shown in FIG. 8 indicate coordinates of the pixels on the LCD panel 1.

As described above, the cache memory 35*a* has a storage capacity of 240 bits, and 240 bits are allocated to the rows (240 rows) of the LCD panel 1, respectively. The image data storage unit 33*a* has a storage capacity of 320×240 bits, and these bits are allocated to the pixels (320×240 pixels) of the LCD panel 1, respectively. The image data storage unit 33*a* has a storage capacity of 320×240×3×4 bits, and 4 bits are allocated to each of the display dots (320×240×3 dots) of the LCD panel 1.

Upon completion of writing operation of image data by the CPU 4, when the refresh flag is set to (1)2, the controller 35 performs the following gradation data transfer process and the write process for the frame buffer 33*b* and the cache memory 35*a* in synchronism with the input of a frame signal.

The controller 35 loads gradation data (4-bit data) corresponding to a red dot of a pixel (1,1) from the image data storage unit (to be referred to as an "image data storage unit" hereinafter) 33*a*, in which image data is updated by the CPU 4, of the two arranged image data storage units 33*a*. In the example shown in FIG. 8, in data (000)16 stored at coordinates (001,001) of the image data storage unit 33*a*, "0" (at the left end) of the three "0"s corresponds to the gradation data of the red dot of the pixel (1,1).

The controller 35 performs a transfer process to a built-in memory 2*a* of a driver 2 on the basis of the gradation data (and its address).

Here, when gradation data corresponding to at least one dot of the three dots constituting the pixel (1,1) is not (0)16 or (F)16, in the frame buffer 33*b*, the controller 35 writes (1)2 in the bit corresponding to the bit coordinates (1,1). In the example shown in FIG. 8, since all the three dots constituting the pixel (1,1) of the image data storage unit 33*a* have gradation data of (0)16, in the frame buffer 33*b*, the bit corresponding to the bit coordinates (1,1) is set to (0)2.

Subsequently, the controller 35 also performs a loading process and a transfer process for gradation data corresponding to the display dots (R, G, and B) constituting each of the pixels (2,1) to (320,1) in accordance with the same procedure as described above, and performs a write process to the frame buffer 33*b*.

At this time, when there is one or more bit, having data of (1)2, of the bits corresponding to the pixel group of the first row in the frame buffer 33*b*, i.e., of the bits corresponding to the bit coordinates (1,1) to (320,1), the controller 35 writes (1)2 in a bit corresponding to the first row in the controller 35, i.e., in the bit having bit number 1.

Upon completion of the process for the pixel group of the first row, i.e., for the pixels (1,1) to (320,1), the controller 35 performs a loading process and a transfer process for gradation data corresponding to the display dots (R, G, and B) constituting the pixel group of the second row, i.e., the pixels (1,2) to (320,2), in the same manner as described above, and performs a write process to the frame buffer 33*b*.

As in the pixel group of the first row, when there is one or more bit, having data of (1)2, of the bits corresponding to the pixel group of the second row in the frame buffer 33*b*, i.e., of the bits corresponding to the bit coordinates (1,2) to (320,2), the controller 35 writes (1)2 in the bit having bit number 2.

The controller 35 sequentially performs the same processes as described above to the pixel groups of the third to 240th rows.

Here, for example, in the example shown in FIG. 8, a display dot corresponding to red, of three dots constituting the pixel (200,50) of the image data storage unit 33*a* has gradation data of (8)16=(1000)2. For this reason, the controller 35 sets data of the bit corresponding to the bit coordinates (200,50) to (1)2 in the cache memory 33*a*. Accordingly, the controller 35 sets the bit corresponding to the 50th row, i,e., the bit having bit number 50, to (1)2 in the cache memory 35*a*.

When the transfer process for the gradation data to the driver 2 and the write process in the frame buffer 33*b* and the cache memory 35*a* are completed in accordance with the above procedure, the controller 35 repeats an updating process for the storage contents of the built-in memory 2*a* (to be described below) in synchronous with a frame signal until next image data is written (updated) by the CPU 4.

As described above, in this device, 15 frames are continuously, sequentially, repetitively displayed to constitute one display screen. As described above, a frame signal is a pulse signal input at an interval of 1/150 sec.

More specifically, when a frame signal is input to the controller 35, the controller 35 performs a transfer process for image data with respect to one frame (temporarily set as the tth frame) a time (1/150 sec) before a next frame signal is input to the controller 35. When the next frame signal is input to the controller 35, the controller 35 performs a transfer process for image data with respect to the (t+1)th frame. Subsequently, each time a frame signal is input to the controller 35, processes for respective frames are sequentially performed. As a matter of course, after the process for the 15th frame is performed, the process for the first frame is performed again.

When a frame signal is input to the controller 35 at the first time, the controller 35 starts the process for the first frame.

Here, the controller 35 loads data (1 bit) having bit number 1 from the cache memory 35*a*. When the data is (0)2, the controller 35 loads data (1 bit) having bit number 2 from the cache memory 35*a*. Subsequently, the controller 35 sequentially and continuously loads data (1 bit) from the cache memory 35*a* until (1)2 is loaded.

When the data having bit number n of the cache memory 35*a* is (1)2, the controller 35 loads data (1 bit) at the bit coordinates (1,n) from the frame buffer 33*b*. When the data is (0)2, the controller 35 loads data (1 bit) at the bit coordinates (2,n) from the frame buffer 33*b*. The controller 35 sequentially and continuously loads data (1 bit) corresponding to the pixels of the nth row from the frame buffer 33*b* until (1)2 is loaded.

The data of the bit coordinates (m,n) of the frame buffer 33*b* is (1)2, the controller 35 loads gradation data (4 bits) corresponding to the red dot of the pixel (m,n) from the image data storage unit 33*a*.

When the gradation data is (0)16 or (F)16, the controller 35 does not perform a transfer process. On the other hand, when the gradation data is not (0)16 or (F)16, the controller 35 performs the transfer process to the built-in memory 2*a* of the driver 2 on the basis of the gradation data (and its address).

The controller 35 loads gradation data (4 bits) corresponding to the green dot of the pixel (m,n) from the image data storage unit 33*a*.

When the gradation data is (0)16 or (F)16, the controller 35 does not perform a transfer process. On the other hand, when the gradation data is not (0)16 or (F)16, the controller 35 performs the transfer process to the built-in memory 2*a* of the driver 2 on the basis of the gradation data (and its address).

Finally, the controller 35 loads gradation data (4 bits) corresponding to the blue dot of the pixel (m,n) from the image data storage unit 33*a*.

When the gradation data is (0)16 or (F)16, the controller 35 does not perform a transfer process. On the other hand, when the gradation data is not (0)16 or (F)16, the controller 35 performs a transfer process (to be described later) to the built-in memory 2*a* of the driver 2 on the basis of the gradation data (and its address).

Subsequently, the controller 35 sequentially and continuously loads data (1 bit) corresponding to the pixels of the nth row up to the data of the bit coordinates (320,n) from the frame buffer 33*b*. When the data is (1)2, the controller 35 performs a loading process for the gradation data to the dots (R, G, and B) of each of the pixels and performs a transfer process for the gradation data if necessary.

Upon completion of a process for the bit corresponding to the last pixel of the nth row, i.e., the bit at the bit coordinates (320,n) in the frame buffer 33*b*, the controller 35 returns to the loading process from the cache memory 35*a*.

Upon completion of a process for the data of last bit number 240 in the cache memory 35*a*, the processes for the first frame are completed.

When the next frame signal is input to the controller 35, the controller 35 performs processes for the second frame in accordance with the same procedure as that of the first frame. Subsequently, each time a frame signal is input to the controller 35, the controller 35 sequentially repeats the same processes as described above to the respective frames while a frame number to be process increments.

The above is the explanation of the updating operation, for the built-in memory 2*a*, performed by the controller 35.

In the third embodiment, data transfer to the driver 2 may be performed with respect to only a display dot having intermediate gradation (1/15 to 14/15) as a gradient.

At this time, according to this embodiment, (1)2 is stored in the bit at the bit coordinates (m,n) corresponding to an intermediate-gradation pixel (having a intermediate-gradation display dot) in the frame buffer 33*b*, and (1)2 is stored in the bit having bit number n corresponding to a row having an intermediate-gradation pixel (having an intermediate-gradation display dot). For this reason, the controller 35 can find only gradation data corresponding to the intermediate-gradation display dot from the image data storage unit 33*a* with reference to the storage contents of the cache memory 35*a* and the frame buffer 33*b* without referring to all the gradation data of the image data storage unit 33*a*.

For this reason, according to this device, an amount of gradation data read from the image data storage unit 33*a* and an amount of data to be transferred to the driver 2 can be made considerably smaller than those of a conventional device.

Although the third embodiment of the present invention have been described with reference to the accompanying drawings, the detailed arrangement of the invention is not limited to the embodiment. Various changes and modifications of the present invention may be effected without departing from the spirit and scope of the invention.

For example, in this embodiment, a loading/writing operation for data between each of memories (the built-in memory 2*a*, the VRAM 33, and the cache memory 35*a*) and the controller 35 may be performed in units of bytes or in units of bits.

In this embodiment, the storage capacity of the frame buffer 33*b* is set to be 320×240=76,800 bits, and these bits are allocated to the pixels (320×240 pixels) of the LCD panel 1, respectively. However, the dividing manner of the display screen of the LCD panel 1 and the storage capacity of the frame buffer 33*b* corresponding to the dividing manner are not limited to the example described above. For example, various combination such as the combination described below may be used. That is, the storage capacity of the frame buffer 33*b* is set to be 2×240=480 bits, and each row (320 pixels) of the LCD panel 1 is divided into two left and right portions each having 160 pixels to form 480 (=2×240 bits) divided regions. The bits (480 bits) of the frame buffer 33*b* are allocated to the divided regions, respectively.

Similarly, the correspondence between the cache memory 35*a* and the LCD panel 1 is not limited to the example described in the this embodiment.

In each of the embodiments, one screen is constituted by 15 frames, and the gradation of each of the display dots in the screen is determined depending on the ratio of ON state/OFF state in the 15 frames. However, the number of frames constituting one screen is not limited to 15, and may be smaller or larger than 15.

The correspondence between each means described in claims and the third embodiment will be described below.

Gradation information . . . Image data storage unit 33*a* storage means

First presence/absence . . . Frame buffer 33*b* information storage means

Second presence/absence . . . Cache memory 35*a* information storage means

First presence/absence . . . Controller 35 write means

Second presence/absence . . . Controller 35 write means

First detection means . . . Controller 35

Second detection means . . . Controller 35

Gradation information . . . Controller 35 read means

Drive means . . . Driver 2

Display means . . . LCD panel 1

Gradation information write means . . . CPU 4

EXAMPLE

An example related to comparison between the conventional device (see FIG. 9) and the third embodiment (see FIG. 6) with respect to an amount of transferred data will be described below.

The conditions of this example are described below.

1 The size of the LCD panel 1 is 320 (horizontal)×240 (vertical) pixels.

2 Each pixel of the LCD panel 1 is constituted by three red (R), G (green), and B (blue) dots.

3 In the LCD panel 1, each display dot can be displayed at 16 gradation levels (0/15 to 15/15).

4 The gradation of a ¼ portion of the display screen of the LCD panel 1 is set to be intermediate gradation having a gradient of 8/15 (≈53), and the remaining has a gradient of 0% or 100%.

5 In the conventional device and the third embodiment, the frequency of a frame signal is set to the same value (150 Hz).

The results obtained by the example under the above conditions are as follows.

(1) Conventional Device a. Amount of Data Transferred from Controller 105 to Driver 102

In the conventional device, since data (1 bit) representing the ON/OFF states of all the dots must be transferred to the driver 102 in all the frames, an amount of transferred data per screen (15 frames) is given by:

320×240×3×15=3,456,000 bits=432,000 bytes.

b. Amount of Data Transferred from Image Data Storage Unit 3*a* to Controller 105

In the conventional device, since gradation data (4 bits) of all the display dots must be read from the image data storage unit 3*a* in all the frames, an amount of transferred data per one screen (15 frames) is given by:

320×240×3×4×15=13,824,000 bits=1,728,000 bytes.

However, in this case, since an address for designating gradation data to be read must be transferred, an actual amount of transferred data becomes twice the calculated data. That is, 1,728,000×2=3,456,000 bytes.

c. Total

When the values a. and b. are summed, an amount of transferred data per screen (15 frames) is given by:

432,000+3,456,000=3,888,000 bytes.

(2) Third Embodiment a. Amount of Data Transferred from Controller 35 to Driver 2

In the third embodiment, since data (1 bit) representing the ON/OFF states of only display dots (¼ of all the dots) for performing a display in intermediate gradation may be transferred for only two frames, an amount of transferred data per screen (15 frames) is given by:

320×240×3×(¼)×2=115,200 bits=14,400 bytes.

However, in the third embodiment, coordinate data (address) for designating the display dots must be transferred together with the above data. For this reason, an actual amount of transferred data becomes twice the calculated value. That is, 14,400×2=28,800 bytes.

b. Amount of Data Transferred from VRAM 33 to Controller 35

In third embodiment, the frame buffer 33*b* is accessed on the basis of the storage contents of the cache memory 35*a*. Here, since the cache memory 35*a* is built in the controller 35, only amounts of data transferred from the frame buffer 33*b* and the image data storage unit 33*a* are posed as a problem in terms of a current consumption during data transfer. At this time, an amount of data transferred from the frame buffer 33*b* is given by:

320×(240/2) =38,400 bits=4,800 bytes.

On the other hand, an amount of data transferred from the image data storage unit 33*a* is given by:

(320/2)×(240/2)×3×4×2=460,800 bits=57,600 bytes.

However, in this case, since an address for designating gradation data to be read must be transferred, an actual amount of transferred data is twice the calculated value. That is, 57,600×2=115,200 byte Therefore, a total amount of transferred data when the VRAM 3 is accessed is given by:

4,800+115,200=120,000 bytes.

c. Total

The values of a. and b. are summed, an amount of transferred data per screen (15 frames) in the above embodiment is given by:

28,800+120,000=148,800 bytes.

(4) Comparison Result

As described above, a total amount of transferred data per screen (15 frames) in the third embodiment is about 1/26 (≈3,888,000÷148,800) that of the conventional device. Accordingly, a current consumption also decreases.

In the third embodiment, as condition 4 described above, the intermediate-gradation area is set to be ¼ the area of the display screen of the LCD panel 1. However, a difference between the current consumption of the conventional device and the current consumption of this embodiment increases as the intermediate-gradation area decreases.

As has been described above, according to the present invention, since an amount of data transferred between a gradation information storage means and a display means decreases, a current consumed in the data transfer can be held down.

What is claimed is:

1. A display control device characterized by comprising:

gradation information storage means for storing, in correspondence with each display dot of display means constituted by a plurality of display dots, gradation information representing display gradation of the display dot;

presence/absence information storage means for storing, with respect to divided regions obtained by dividing a storage region of said gradation information storage means into a plurality of regions, presence/absence information representing a predetermined value in correspondence with each divided region when at least one piece of gradation information stored in the divided regions represents intermediate gradation;

presence/absence information write means for writing the presence/absence information in said presence/absence information storage means on the basis of the gradation information stored in said gradation information storage means;

detection means for detecting only a divided region, in which at least one piece of stored gradation information represents intermediate gradation, from the divided regions constituting said gradation information storage means on the basis of the presence/absence information stored in said presence/absence information storage means;

gradation information read means for loading only gradation information representing intermediate gradation from the divided region detected by said detection means and outputting the gradation information; and drive means for storing the gradation information output from said gradation information read means and driving and displaying a display dot corresponding to the gradation information in display gradation represented by the gradation information on the basis of the stored gradation information.

2. A display control device according to claim 1, characterized in that said gradation information storage means and said presence/absence information storage means are arranged in the same integrated circuit.

3. A display control device according to claim 1, characterized in that at least one of said presence/absence information write means, said detection means, and said gradation information read means, and said presence/absence information storage means are arranged in the same integrated circuit.

4. A display control device according to claim 1, characterized in that said display means is constituted by rows of pixels in units of pixels constituted by a predetermined number of display dots, and the divided regions are regions obtained by dividing a storage region of said gradation information storage means in correspondence with the respective rows.

5. A display control device according to claim 1, characterized in that said display means is constituted by rows of pixels in units of pixels constituted by a predetermined number of display dots, and the divided regions are regions obtained by dividing a storage region of said gradation information storage means in correspondence with the plurality of pixels constituting the respective rows.

6. A display control device according to claim 1, comprising count means for repetitively counting a first predetermined number to a second predetermined number, characterized in that said drive means comprises:

designation information storage means for storing, in correspondence with the display dots of said display means, designation information representing whether the display dots are set in one of an ON state and an OFF state; and flicker means for setting each corresponding display dot in one of an ON state and an OFF state on the basis of the designation information stored in said designation information storage means, and said gradation information read means comprises:

gradation information loading means for loading only gradation information representing intermediate gradation from a divided region detected by said detection means; and designation information write means for writing designation information in said designation information storage means with respect to only the gradation information loaded by said gradation information loading means on the basis of the gradation information and a present number indicated by said count means.

7. A display control device according to claim 6, characterized in that said designation information storage means and said flicker means are arranged in the same integrated circuit.

8. A display device characterized by comprising:

a display control device according to claim 1;

display means constituted by a plurality of display dots; and gradation information write means for writing arbitrary gradation information in said gradation information storage means.

9. A display device according to claim 8, characterized in that said display means is a liquid-crystal display panel.

10. A display control device characterized by comprising:

gradation information storage means for storing, in correspondence with each display dot of display means constituted by a plurality of display dots, gradation information representing display gradation of the display dot;

first presence/absence information storage means for storing, with respect to first divided regions obtained by dividing a storage region of said gradation information storage means into a plurality of regions, first presence/absence information representing a first predetermined value in correspondence with each first divided region when at least one piece of gradation information stored in the first divided regions represents intermediate gradation;

second presence/absence information storage means for storing, with respect to second divided regions obtained by dividing a storage region of said first presence/absence information storage means into a plurality of regions, second presence/absence information representing a second predetermined value in correspondence with each second divided region when at least one piece of gradation information stored in the second divided region has the first predetermined value;

first presence/absence information write means for writing the first presence/absence information in said first presence/absence information storage means on the basis of the gradation information stored in said gradation information storage means;

second presence/absence information write means for writing the second presence/absence information in said second presence/absence information storage means on the basis of the first presence/absence information stored in said first presence/absence information storage means;

first detection means for detecting only a second divided region, in which at least one piece of stored first presence/absence information represents the first predetermined value, from the second divided regions constituting said first presence/absence information storage means on the basis of the second presence/absence information stored in said second presence/absence information storage means;

second detection means for detecting only a first divided region, in which at least one piece of stored gradation information represents intermediate gradation, from the first divided regions constituting said gradation information storage means on the basis of the first presence/absence information stored in the second divided region detected by said first detection means;

gradation information read means for loading only gradation information representing intermediate gradation from the first divided region detected by said second detection means and outputting the gradation information; and drive means for storing the gradation information output from said gradation information read means and driving and displaying a display dot corresponding to the gradation information in display gradation represented by the gradation information on the basis of the stored gradation information.

11. A display control device according to claim 10, characterized in that said gradation information storage means and said first presence/absence information storage means are arranged in the same integrated circuit.

12. A display control device according to claim 10, characterized in that at least one of said first presence/absence information write means, said second presence/absence information write means, said first detection means, said second detection means, and said gradation information read means, and said second presence/absence information storage means are arranged in the same integrated circuit.

13. A display control device according to claim 10, characterized in that said display means is constituted by rows of pixels in units of pixels constituted by a predetermined number of display dots, the first divided regions are regions obtained by dividing a storage region of said gradation information storage means in correspondence with the pixels of the rows; and the second divided regions are regions obtained by dividing a storage region of said first presence/absence information storage means in correspondence with the respective rows.

14. A display control device according to claim 10, comprising count means for repetitively counting a first predetermined number to a second predetermined number, characterized in that said drive means comprises:

designation information storage means for storing, in correspondence with the display dots of said display means, designation information representing whether the display dots are set in one of an ON state and an OFF state; and flicker means for setting each corresponding display dot in one of an ON state and an OFF state on the basis of the designation information stored in said designation information storage means, and said gradation information read means comprises:

gradation information loading means for loading only gradation information representing intermediate gradation from a first divided region detected by said second detection means; and designation information write means for writing designation information in said designation information storage means with respect to only the gradation information loaded by said gradation information loading means on the basis of the gradation information and a present number indicated by said count means.

15. A display control device according to claim 14, characterized in that said designation information storage means and said flicker means are arranged in the same integrated circuit.

16. A display device characterized by comprising:

a display control device according to claim 10;

display means constituted by a plurality of display dots; and gradation information write means for writing arbitrary gradation information in said gradation information storage means.

17. A display device according to claim 16, characterized in that said display means is a liquid-crystal display panel.

* * * * *